United States Patent [19]

Miller et al.

[11] 4,041,623

[45] Aug. 16, 1977

[54] GRADE CUTTING MACHINE

[75] Inventors: David J. Miller; Charles P. Miller, both of McHenry, Ill.

[73] Assignee: Miller Formless Co., Inc., McHenry, Ill.

[21] Appl. No.: 615,767

[22] Filed: Sept. 22, 1975

[51] Int. Cl.[2] ..... E02F 5/00; E02F 3/76

[52] U.S. Cl. ..... 37/108 R; 180/9.44; 37/DIG. 1; 37/DIG. 20; 172/4.5; 404/84; 180/9.5; 280/6.1

[58] Field of Search ..... 37/108 R, 108 A, 190, 37/DIG. 14, DIG. 20, DIG. 1; 172/2, 4, 4.5, 26; 404/84; 180/9.44, 9.46, 9.5, 9.57; 280/6.1, 6.11

[56] References Cited

U.S. PATENT DOCUMENTS

| | | | |
|---|---|---|---|
| 3,221,425 | 12/1965 | Thomas | 37/108 R X |
| 3,423,859 | 1/1969 | Swisher, Jr. et al. | 37/108 R |
| 3,452,461 | 7/1969 | Hanson | 37/108 X |
| 3,540,360 | 11/1970 | Snow, Jr. et al. | 37/108 A X |
| 3,554,291 | 1/1971 | Rogers et al. | 172/4.5 |
| 3,610,341 | 10/1971 | Swisher, Jr. et al. | 172/4.5 |
| 3,637,026 | 1/1972 | Snow | 172/4.5 |
| 3,651,588 | 3/1972 | Hanson | 37/108 R |
| 3,693,722 | 9/1972 | Brown | 37/108 |
| 3,749,504 | 7/1973 | Smith | 404/84 |
| 3,778,912 | 12/1973 | Swisher, Jr. et al. | 37/DIG. 20 X |
| 3,779,661 | 12/1973 | Godbersen | 404/84 X |
| 3,802,525 | 4/1974 | Snow, Jr. et al. | 37/108 R X |
| 3,900,077 | 8/1975 | Gee et al. | 180/9.46 |
| 3,917,015 | 11/1975 | Hawkins | 404/84 X |

*Primary Examiner*—E. H. Eickholt
*Attorney, Agent, or Firm*—Bruce K. Thomas

[57] ABSTRACT

A grade cutting machine having an elongated main frame supported on three bogey-mounted individually driven endless tracks. The cutting tool is rotatably mounted on an axis transverse the front of the main frame within an enclosing bowl. A vertically adjustable moldboard is provided across the back wall of the bowl behind the cutting tool. Two of the endless tracks are mounted on vertical non-rotatable axes on opposite sides of the main frame behind the moldboard and each is provided with an extensible frame-supporting member for automatic simultaneous or independent vertical adjustment. The third endless track which can control the steering under certain conditions is provided with an extensible frame-supporting member connected for independent manually controlled vertical adjustment. In one embodiment the drive means for the front pair of endless tracks are under the control of the steering function of the rear endless track so that, as a steering correction is made, the front endless track on the outside of the curve is driven faster while the front endless track on the inside of the curve is driven slower, the speed differences being inversely proportional to the radius of the curve being negotiated. A conveyor having a pivotal rear section under the control of dual rams through dual levers for deposit of the cuttings anywhere in a 180° arc is provided. The moldboard is under the control of a pair of rams and carries both the grade sensor and the slope pendulum control whereby slope corrections are isolated from grade corrections.

14 Claims, 16 Drawing Figures

FIG. 5
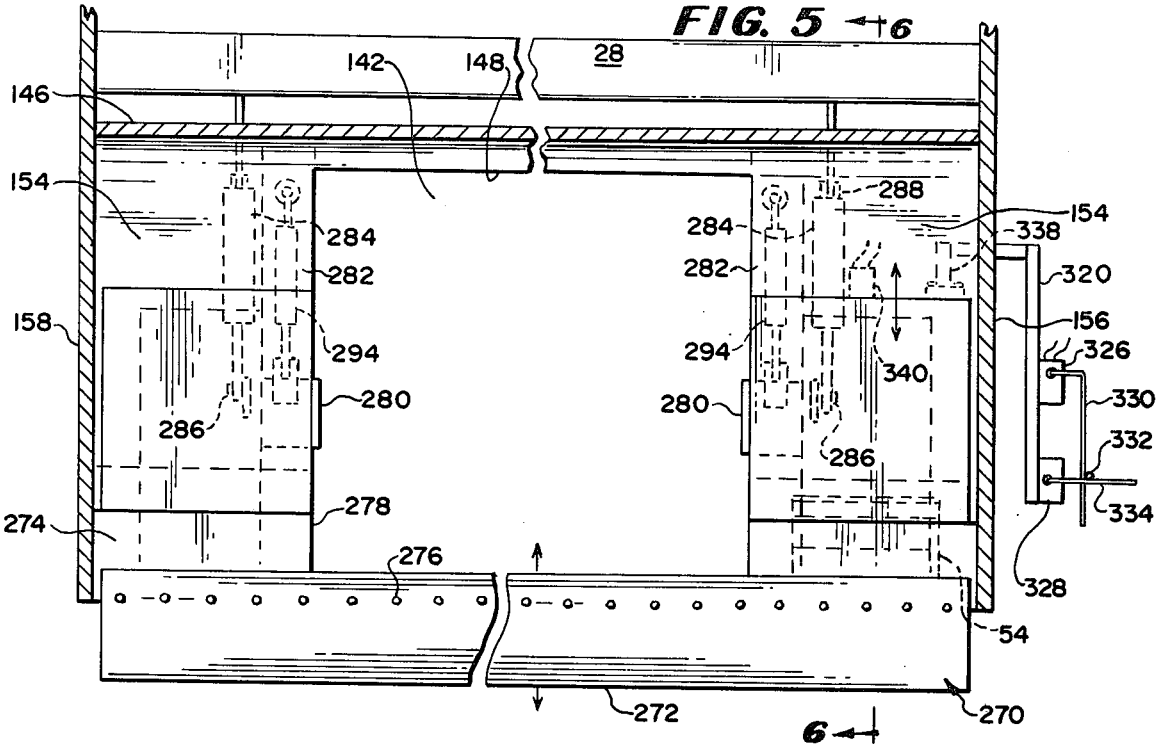
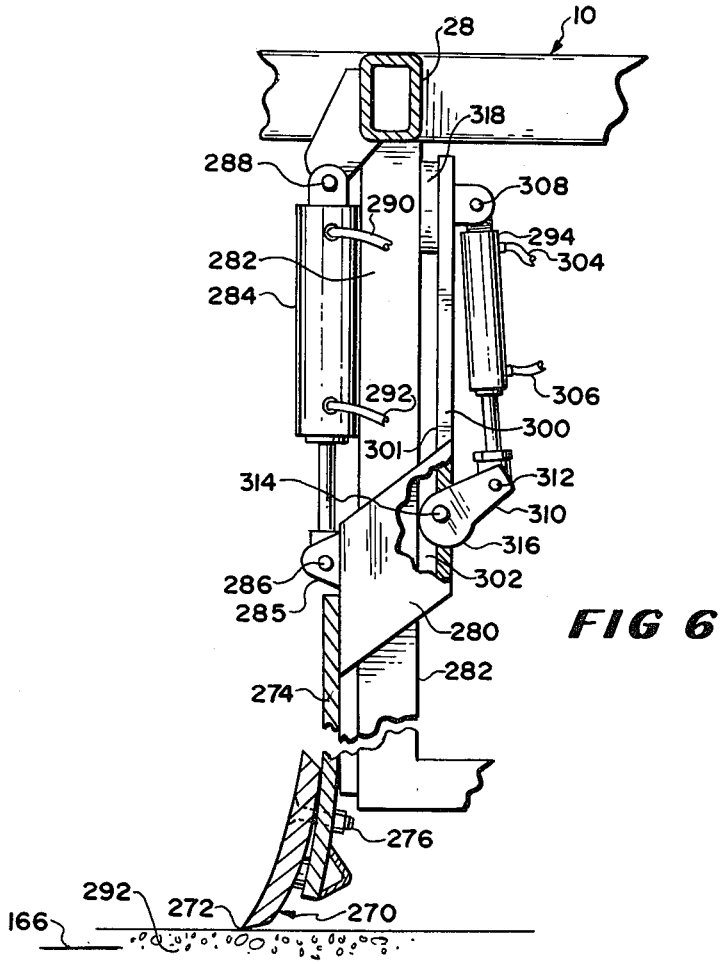
FIG 6

GRADE CUTTING MACHINE

BACKGROUND OF THE INVENTION

In the road-building art it is the practice to first rough grade stretches of the proposed roadbed to approximate the predetermined grade and slope by using manually controlled earth grading machines. These operations define the general path of the roadbed and fill in the major depressions or cut off the major elevations along the path and deposit comminuted earth in a fairly even fashion along the path traversed by the machinery. This generally requires several passes of the machinery and is an expensive initial operation.

Following the rough grading it is necessary to fine grade the roadbed to rather close tolerances for the purpose of providing a bed for deposit of the base materials on which the concrete slabs will be laid by paving machines. The fine grading machines are more sophisticated and include means for finite control of the grade and slope of the working tools which include augers, scrapers and screeds adapted to prepare the finished grade to close specifications.

SUMMARY OF THE INVENTION

In accordance with this invention a rugged grade cutting machine is provided, designed to cut a finished grade in a single pass without the necessity of sequential rough and finished grade operations. The machine is capable of cutting rough terrain to a depth of 12 inches or more and within specifications for grade and slope meeting finished grade tolerances with a minimum or prescribed amount of loosened earth of "fluff" over the cut area.

The machine rests primarily on the front pair of endless tracks which control the grade and slope through their adjustable vertical supports connected to the frame. The third track being in the rear rides on the finished grade and maintains the longitudinal angle of the cutting blade within prescribed limits. The third track is manually adjustable for vertical height by its adjustable support so that by raising the rear of the frame the cut can be started, then as soon as the track is on finished grade it is again adjusted to level the machine longitudinally so that the front extensible members are at the midpoints of their limits of extension and are capable of maximum up and down movement as the machine progresses. The articulated conveyor system moves the earth to the rear where it can be dumped at any selected position in a 180° arc. The geometry of the cutting teeth is altered over prior art structures to provide uniform cutting longitudinally and transversely of the grade.

The provision for rear steering places the rear tractor out of the path of the grade line on both left and right curves. By coordinating the degree of steer with the degree of drive on the pair of front tractors while at the same time being able to coordinate the speed of operation of the outside tractor with the angle of turn of the rear tractor on a curve assures correct alignment of the tool with the grade line at all times. By attaching the grade sensor to the adjustable moldboard the depth of fines or fluff left on the finished grade in under finite control. The grade sensor is adjustably mounted on the moldboard so that its relation to the grade line can be fixed once the moldboard adjustment is made.

DESCRIPTION OF THE DRAWINGS

Illustrative embodiments of the invention are shown in the drawings wherein:

FIG. 5 is a cross-sectional view taken along the lines 5—5 of FIG. 2;

FIG. 6 is an enlarged cross-sectional view taken along the lines 6—6 of FIG. 5;

DESCRIPTION OF THE PREFERRED EMBODIMENT

Figure 1:
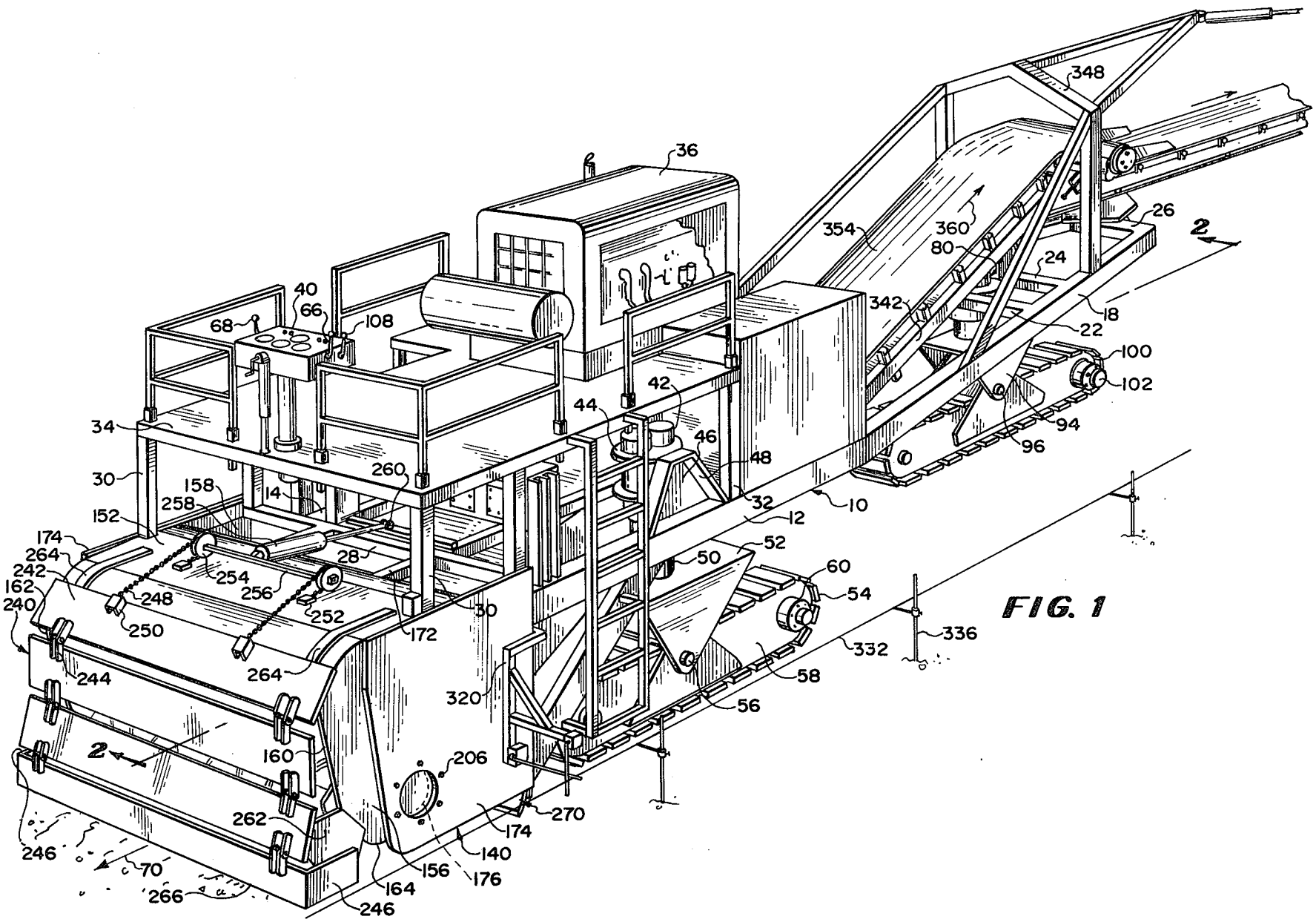
FIG. 1 is a fragmentary perspective view of the machine of this invention.
Figure 2:
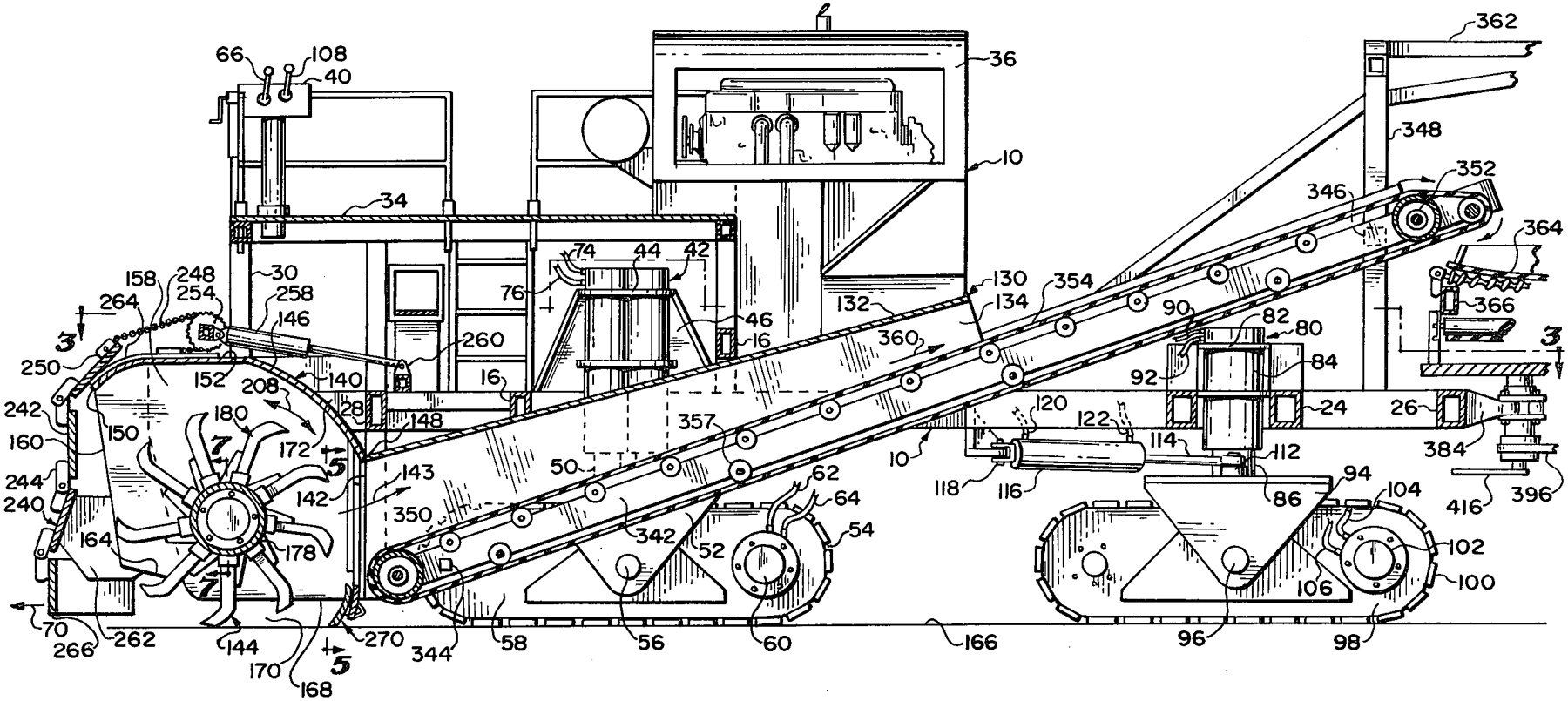
FIG. 2 is a longitudinal cross-sectional view taken along the lines 2—2 of FIG. 1.
Figure 3:
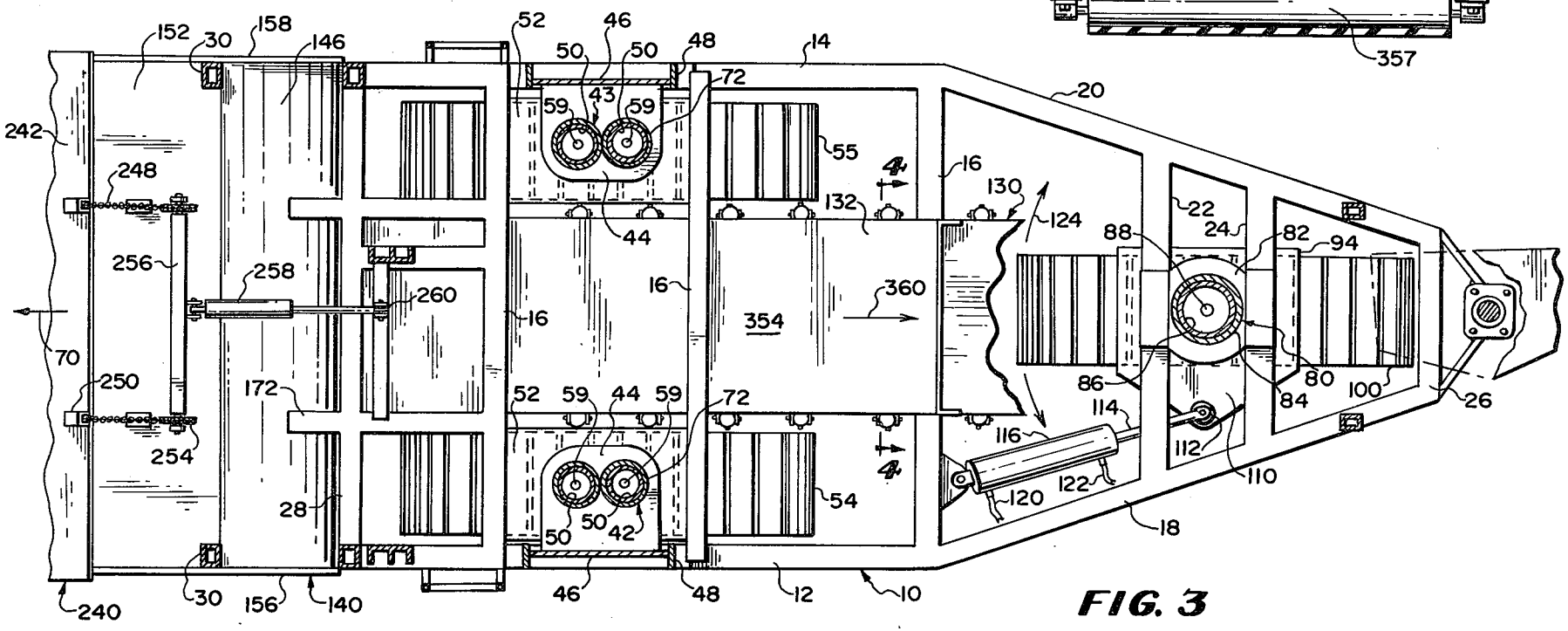
FIG. 3 is a cross-sectional view taken along the lines 3—3 of FIG. 2.

Referring to FIGS. 1, 2 and 3 the general relationship of the parts will first be described. The main frame 10 is comprised of a rectangular front section with the longitudinal parallel side beams 12 and 14 tied together by the transverse beams 16 and the rear triangular section with the converging side beams 18 and 20 tied together by the transverse beams 22 and 24 and the rear most cross-beam 26. The frame 10 is constructed of heavy box beams so as to resist any twisting action during operation of the machine over any terrain.

A rigid front transverse beam 28, just ahead of the forward beam 16 completes the essential parts of the main frame. A number of spaced vertical uprights, such as those illustrated at 30 and 32 on one side of the machine and corresponding uprights on the other side support the working platform 34 over the front section of the frame. The power plant 36 and the control console 40 are the primary components on the platform from which the operator can see and control all functions of the machine.

Still referring to FIGS. 1, 2 and 3 there is provided a pair of vertical guide cylinder assemblies 42 and 43 on opposite sides of the main frame. Each pair of guide cylinders is positioned and affixed to the inside of the respective frame members 12 and 14, (best shown in FIG. 3) by means of welding and the structure is shown to include one or more spaced reinforcing plates 44 and the upright side gusset plates 46 with the reinforcing plates 48 to rigidity the assembly.

Inside each of the pairs of stationary guide cylinders 42 and 43, which are identical in diameter and length, there is provided an upright sleeve, indicated at 50. The lower ends of the four sleeves are attached in pairs to the respective forward saddle mounts 52 that are pivotally mounted to the endless tractor units 54 and 55 by means of the transverse pins 56. The pins 56 are located at the midpoint of the track frames 58 and both of the tractors are opposite each other and of substantially equal length and width.

Within each of the sleeves 50, a ram 59 is provided. One end of each ram 59 is attached at its upper end to the top of the respective guide cylinder 42 and 43. The other end of each ram 59 is connected to the bottom of the respective sleeve or to the top of the saddle 52. These connections include at least one pintal pin so that the rams are free to extend and retract without binding. The use of a pair of guide cylinders, sleeves and rams on each side of the frame holds the tractor units 54 and 55 in parallel alignment with the frame 12 as the machine moves along its path of travel.

Each tractor unit is equipped with an individually controlled drive motor, only one of which is illustrated at 60 in FIG. 2 for the right hand tractor. The pair of hydraulic lines 62 and 64 (FIG. 2) represent the intake and exhaust conduits for the hydraulic fluid used to drive the motor 60, and the opposite tractor 55 has a similar drive motor. A source of hydraulic fluid, a pump and suitable connections to the prime mover 35 is provided and the details thereof will be discussed.

In one embodiment the console 40 includes manual levers 66 and 68 to control the amount and flow direction of the hydraulic fluid to and from the lines 62 and 64 to drive, stop or reverse the motors 60, and perform other functions. The controls can be designed for individual operation or one lever can control all track motors through a variable pump. The normal or forward direction of travel of the machine during grade preparation and digging operations is shown by the arrow 70.

The guide cylinder assemblies 42 and 43 function as extensible vertical support means for the frame 10 upon the tractors 54 and 55. The height, grade and slope of the frame 12 and working tools are controlled by the simultaneous or individual extensions or retractions of the pairs of rams 59 (see FIG. 3) in these assemblies on each side of the frame. The hydraulic lines 74 and 76 (FIG. 2) illustrate the means used to accomplish these adjustments, one line being connected to each of the pair of rams therein. Since the weight of the machine will cause the rams 59 to retract when the pressure is relieved, single-acting rams can be used, in which event only one hydraulic line would lead to each of these extensible support means.

To the rear of the machine, where the frame narrows, at the longitudinal beams 18 and 20, the pair of transverse beams 22 and 24 provide a support for the rear extensible vertical support means 80, the assembly of which differs somewhat from the front support means 42 and 43. This arrangement includes the fixed reinforcing yoke plates 82, welded between these transverse beams and holding the single guide cylinder 84 in a central upright position. This guide cylinder 84 has the inner reciprocating sleeve 86 and ram 88 connected to the hydraulic lines 90 and 92 to the source of pressurized hydraulic fluid as previously described.

Normally, the flow of hydraulic fluid to and from the ram 88 at the rear of the machine is under manual control from the console 40 to adjust the vertical height of the rear of the machine to start grade cutting operations or manipulating the machine over obstacles or onto a trailer. The manual operation of the rear extensible support member 80 can be by push button switches from the console 40.

Alternately, automatic control of the rear extensible member 80 can be used, however, one of the features of this invention is to provide a machine which functions primarily upon two points of movable suspension once the longitudinal angle of the machine has been set within prescribed limits by the rear centrally located vertically adjustable and steerable suspension 80.

The inner sleeve 86 is affixed to the rear saddle mount 94 which is pivoted centrally and transversely on the pivot pin 96 carried by the rear track frame 98 of the rear tractor 100. The rear tractor 100 is of the endless track variety driven by the hydraulic drive motor 102 having the inlet and outlet hydraulic lines 104 and 106, connected through the console 40 and a manual control valve, the handle of which is indicated at 108. This tractor 100 can be a duplicate of the tractors 54 as far as size, length and power are concerned. Preferably, a shorter tractor is used at this position.

The rear tractor 100 is pivotally mounted from the frame 10 on a vertical steering axis by means of the rear extensible support means 80, consequently, the guide sleeve 84 is fixed to the frame while the inner sleeve 86 is free to rotate therein. This means that the conduit lines 90 and 92 are so attached through the top of assembly 80 such that both a vertical reciprocating and planar rotational movement can be accomplished. The latter function need only be about 25° on each side of the center line of the frame for most purposes and generally no more than about 40° on each side of the center line will suffice although this is not a limitation upon the machine or its functions.

The rear saddle 94 has a side extension plate 110 (FIG. 3) with a suitable pivot or swivel mount 112 to which is attached the piston rod 114 of the steering ram 116, (seen in FIGS. 2 and 3) the other end of which is attached to the transverse frame member 16 by means of the pivot-swivel mount 118. The inlet and outlet hydraulic lines for the steering ram 116 are shown at 120 and 122. The extension and retraction of the ram 116 causes the rear tractor 100 to pivot about the axis of its adjustable vertical support 80 and swing the rearward portion of the tractor along the arrow 124 (FIG. 3) in the performance of the above related function.

The amount of steering correction imparted by the ram 116, as will be more completely described, is directly coordinated with the respective driving speed differentials of the front pair of tractors. By these means the shifting pivot point of the frame due to the twist or crabbing action of the front tractors as one is speeded up or the other slowed down, in negotiating a predetermined curve by sight of the operator or through sensors in contact with a grade reference, is stabilized. The rear steering action or angle of turn is les with a lesser speed differential of the front tractors and greater with a greater speed differential or these drive units. Before these functions are described the working tools of the machine and their operations must be understood.

From the description thus far, it is seen that the frame 10 is supported in the front by a pair of ground engaging means 54 and 55 located on each side of the frame, and substantially opposite each other, and, in the rear by a single ground engaging means 100 located substantially central of the front pair of ground engaging means. All three ground engaging means are individually powered either manually or automatically to drive the machine. Each tractor can be driven at a selected speed or raised and lowered independently of the others, manually or automatically.

Figure 4:
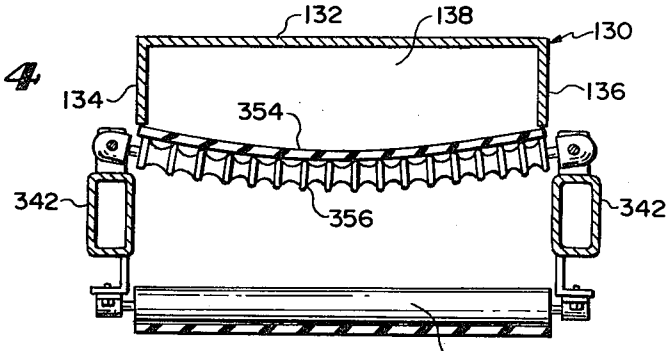
FIG. 4 is a cross-sectional view taken along the lines 4—4 of FIG. 3.

Just over and between the front pairs of tractors, the frame 10 carries the elongated open-bottomed chute or housing 130 defined by the inclined (front to rear) top wall 132 connected to the substantially parallel spaced longitudinal side walls 134 and 136 (see particularly FIG. 4), with the space 138 therein provided to contain the earth cuttings formed by the machine.

The top wall 132 is somewhat narrower than the frame 10 and is variously affixed and carried thereby through suitable attachments to the cross members 16, the details of which are not related to the invention.

The top wall 132 as well as the side walls 134 and 136 join the front scoop 140 to define the rectangular opening 142 (see also in FIG. 5) so that loosened earth, stones and debris formed by the cutting tool 144 are received therethrough as indicated by the arrow 143 as the machine advances.

To accomplish this purpose and direct the cuttings into the opening 142, the front scoop 140 has the top arcuate wall 146 joined to the top wall 132 at the weldment or corner 148. This top wall 146 terminates at the forward transverse edge 150 which is lower than the relatively horizontal top wall portion 152, and has a pair of vertical wall sections 154 and the outer side walls 156 and 158 (see FIG. 5). As seen in FIGS. 5 and 6, the back walls 154 extends to each side of the opening 142 and their inner edges join with the walls 134 and 136 to define the opening 142. The leading front edges of the side walls 156 and 158, indicated at 160 and 162 in FIG. 1, and one of which is shown in FIG. 2, terminate above the ground in the offset 164 which is higher from the ground or grade level 166 than the lower edges of the side plates 156 and 158 as indicated by the bottom edge 168 of the side wall 158 in FIG. 2.

During the normal operations of the machine the working space 170 between the ground level 166 and the lower edges 168 of the scoop will be subject to change depending on the type of work to be performed. This adjustment being a function of either or both the front and rear suspension system of the machine.

Because of the severe torque and impingement of stones and debris against the inside of the scoop 140 due to the action of the cutting tool 144, it is formed of heavy 1½ steel plate, all junctures are carefully welded, and it is firmly affixed to the front of the frame 10 by the uprights 30 and additional braces 172 (FIGS. 1, 2 and 3). If desired, an outer reinforcing plate 174 can be welded to the side plates 156 and 158 as shown in FIG. 1 and suitably attached at the rear edges to the sides of the frame.

The side walls 156 and 158 of the scoop are provided with axially aligned side apertures 176 so spaced from the walls 146 and 150 and the bottom edges 168 as to locate the driven shaft 178 (FIGS. 2 and 7) carrying the plurality of cutting arms or teeth 180 about its circumference in proper working relationship therein. The teeth 180 of the working tool 144 are particularly arranged in accordance with one aspect of this invention.

Figure 7:
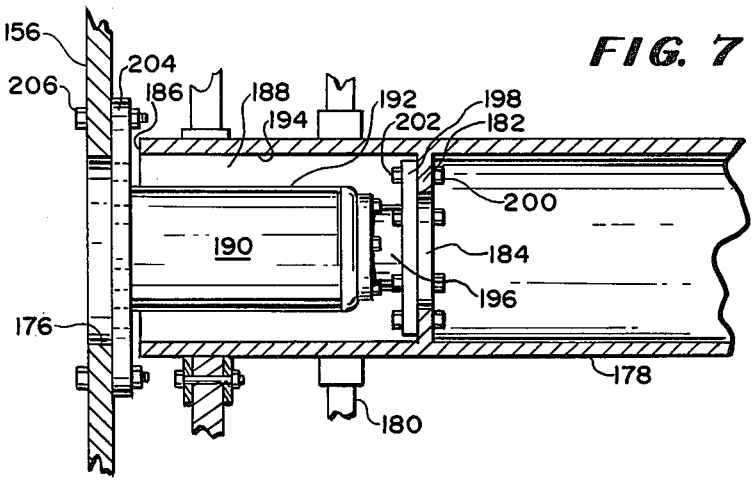
FIG. 7 is an enlarged fragmentary cross-sectional view taken along the lines 7—7 of FIG. 2.

Referring more particularly to FIG. 7, the shaft 178 is a hollow elongated cylinder defining the internal radial flange 182 through which the opening 184 extends. The flange 182 is spaced inwardly from the end 186 of the shaft to provide the recess or bore hole 188 large enough to receive the motor-gear box drive 190.

The housing 192 of the motor-gear box drive is spaced from the inner wall of 194 of the shaft has the thrust bearing 196 rotatably supporting the rotor shaft therein and carries the drive flange 198 at the inner end. The drive flange 198 is affixed to the flane 182 by means of the through-bolts 200 which may be affixed through suitably circumferentially spaced holes in the flange. By these means the threaded shanks will protrude toward the open end of the shaft so that the nuts 202 can be attached or removed as desired during maintenance of the drive motor and the bolts remain in place.

The other end of the motor housing 192 has a fixed circumferential and radially extending flange 204 which is centered over the side hole 176 of the side plate 156 of the bowl 140. The outer reinforcing plate 174 has been omitted from FIG. 7 for simplicity. The flange 204 is affixed to the plate 156 by means of the bolts 206. The hole 176 allows access to one end of the motor 190 for routine inspection if desired.

The motor 190 is sealed from dust and water and preferably permanently lubricated so the maintenance is at a minimum. It is seen that as the motor operates, the housing 192 is fixed to the plate 156 and the drive flange 198 is thus placed in a position to rotate the shaft 178. The hydraulic connections for the motor drive unit 190 are omitted for simplicity. These would ordinarily be external of the scoop so that there is no likelihood of their damage during use of the machine. The other end of the shaft 178 is provided with a similar or duplicate flange 182 and motor-gear box drive unit 190 mounted by its flange 204 to the plate 158. The pair of motors is driven in synchronism and in opposite coordinated directions to cause the shaft to rotate in either direction as indicated by the arrow 208 (FIG. 2).

Figure 8:
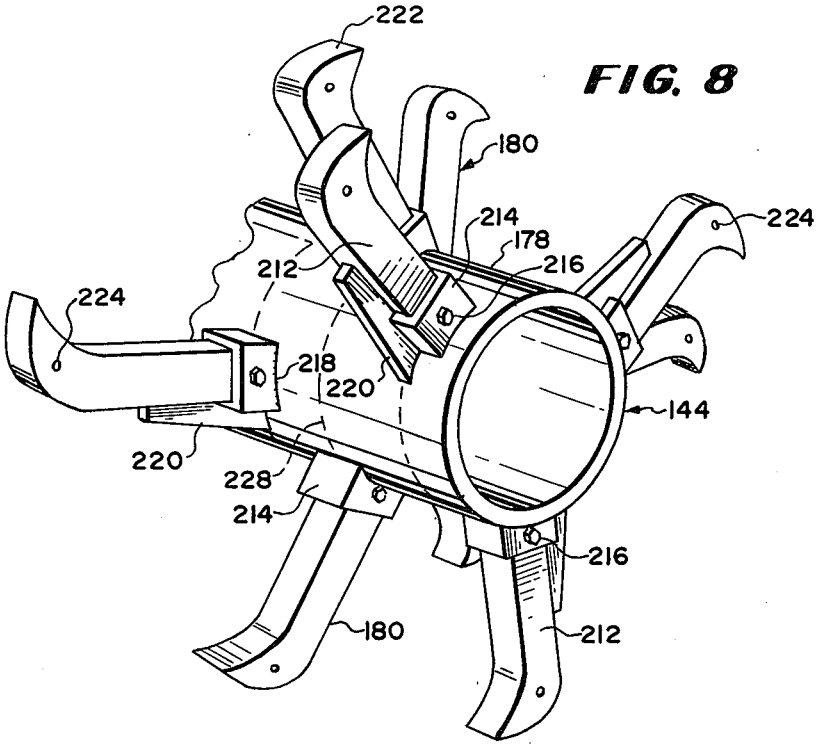
FIG. 8 is a fragementary perspective view of one end of the cutter shaft with cutting blades attached.

Referring particularly to FIG. 8, the shaft 178 is provided with a plurality of cutter bars 180 each having an elongated shank 212 of rectangular or square cross-section which protrude radially therefrom in a predetermined pattern from the outer surface of the shaft determined by the position of the holders 214. Each holder 214, defines a recess to securely receive the base end of the shanks 212 and a bolt 216 is provided which extends through opposite side walls of the holders 214, through a matching bore (not shown) in the shanks to hold same in a rigid position. The holders 214 are welded to the shaft 178 at the weldments 218, and the base ends of the shanks preferably abut the outer surface of the shaft. The base ends of the shanks 212 and the walls of the holders 214 are contoured to conform with the outer curved surface of the shaft.

One wall of the holders is provided with an upright brace or stiffener 220. The inner edge of each brace fits flush against the back side of each cutter bar 180.

A replaceable hardened steel cutting edge or blade (not shown) is normally attached to the arcuate pointed ends 222 of each of the cutter bars and held in place by a bolt or pin passing through the holes 224, in a manner known in this art.

Figure 9:
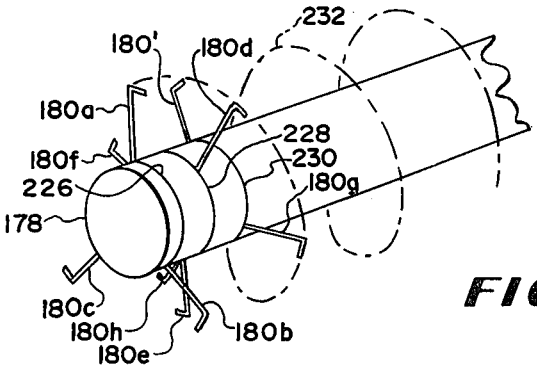
FIG. 9 is a diagrammatic view of the geometric placement of the cutting blades on the cutter shaft.

In one aspect of this invention (see FIG. 9), the cutter bars 180 are arranged in multiples of three or more (cutter bars 180*a*, 180*b* and 180*c*) along a circumferential line 226 of the shaft 178 and extend radially therefrom. The next group of cutter bars 180*d*, 180*e* and 180*f*, are axially spaced from the first group and arranged around a next circumferential line 228 on the shaft 178. However, this next group of cutter bars, 180*d,* 180*e* and 180*f* is offset circumferentially from the first group. Similarly the third group of cutter bars 180*g,* 180*h* and 180*i,* is arranged on the next circumferential line 230.

The cutter bars in each group are equally spaced around the shaft 178, i.e., with three cutter bars in a group, they would be 120° apart. The lines 226, 228 and 230, etc., are spaced equidistant along the length of the shaft. Each cutter bar is located 60° from any one adjacent cutter bar on a neighboring circumferential line. This places the cutter teeth in a spiral (or helix) indicated by the broken line 232 about the shaft. The groups of teeth are extended in this manner along the length of the shaft 178. The effect of this arrangement is to eliminate uncut areas.

The prior art grade cutting tools have only one cutter bar on any one circumferential line, although the cutter bars on each successive circumferential line are set at an angle therefrom and their cutting teeth are in a spiral or helix. The effect of the arrangement is to leave uncut areas of earth fore and aft of the single helical lines of cutters.

Referring to FIGS. 1, 2 and 3, the scoop 140 is provided with the debris deflecting cover 240 comprising the series of slats 242, hinged one to the other by the pairs of hinges 244, wherein the lowermost slat includes the rearwardly extending guide ears 246 on each side. The cover 240 is slidably suspended across the open front of the scoop 140 by means of the pair of chain loops 248 suitably tied at their movable ends by the cleats 250 attached to the top slat and anchored at the other end by the cleats 252 fastened to the top plate 152. The chains engage over the pair of rollers 254 carried at the ends of the shaft 256 and tied to the ram 258 which is suitably pivoted to the frame at its other end as indicated at 260. The side plates 156 and 158 of the scoop can have a guide plate 262 extending inside the guide ears 246 to hold the cover 240 squarely across the front of the scoop. The top wall 152 carries the wear plates 264 to facilitate the sliding action necessary for the cover 240. The ram 258 is operated manually to raise and lower the cover 240 and maintain the lower edge 266 just above the rough terrain being cut by the machine so that there is no danger to personnel as the cutter 144 is rotated.

The moldboard 270 extends across the rear of the scoop 140 along the bottom of the opening 142. As best shown in FIGS. 5 and 6, the moldboard 270 has the cutting blade or edge 272 that extends transverse the machine between the side walls 156 and 158. The blade 272 is held to the guide plate 274 by means of the plurality of bolts 276 and the guide plate is cut out to define the lower margin or edge 278 that conforms with the opening 148 in the rear wall 154 of the scoop.

The guide plates 274 extend upwardly on each side of the opening 142–278 just behind the rear walls 154 of the scoop 140, and have a pair of yoke members 280 that partially encompass the spaced frame struts 282 that provide a back support for the moldboard. One side of each yoke member 280 is fastened to a plate 274 and is also tied to one of the pair of rams 284 by means of the bracket 285 and the pivot 286. The top ends of the rams 284 are similarly pivoted, as at the pins 288 to the cross member 28 of the frame. Thus, simultaneous operation of the rams 284, which are double-acting through the hydraulic lines 290 and 292, moves the moldboard vertically in relation to the frame 12 and cutter 144, thereby leaving the layer of so-called fluff 292 above the cut grade 166 (see FIG. 6).

In order to hold or lock the moldboard in predetermined vertical positions the locking rams 294 (only one shown) are provided in the back side of the frame struts 282 which are carried on the slides 300 of the yokes. The yokes 280 encompass the struts 282 and the back walls 301 are spaced as at 302.

The rams 294 are simultaneously operated by manually controlled valves through the hydraulic lines 304 and 306. Each ram is fixed at its top end to the frame through the slides 300 by pivots 308 and connected to the links 310 at the other end. The links 310 are pivoted at pins 312 to the rams and at pins 314 to the yoke wall 301. The other end of the links 310 have the cam surface 316 that is engageable with the back side of the guides 282. Operation of the rams 294 pivots the links 310 and causes the cams 316 to tighten against the back sides of the guides 282 thereby locking the moldboard at any finite position along its vertical path. The yoke slide 300 can have a bearing pad 318 at its upper end to function as a spacer and reciprocating guide, as these parts are carried by the molboard.

In FIGS. 1 and 5 the bracket 320 is shown attached to the extension or guide plate 274 of the moldboard and extends behind the side plate 156 to suspend the steering sensor 326 and the grade sensor 328 at a central position about opposite the edge of the moldborad 270. The pendant sensing arm 330 of the steering sensor 326 contacts the inside of the guide line 332 while the balanced sensor arm 334 of the grade sensor contacts the under side of the guide line 332. The guide line is suspended along the grade by means of the support posts 336 in a manner known in the art. A manual screw jack 338 also supported by a bracket can be used to adjust the height of these sensors in relation to the grade line.

The moldboard 270 also carries the gravity-actuated pendulum control 340 at about the center line of the tractor 54, shown in broken lines in FIG. 5. The opposite tractor is not so illustrated in FIG. 5.

A pair of conveyor frame members 342 (FIGS. 1, 2, 4 and 10) extend in spaced relationship from the opening 142 at an inclined angle to the rear of the machine and are suitably supported by the members 344 at the front lower end and by the tie members 346, connected to the upright frame struts 348 at the rear raised end. The frame has the rollers 350 and 352 at its end, one or both of which can be driven by the suitable hydraulic motor, (not shown) or other drive means to carry the conveyor belt 354 thereover. The frame 342 carries the plurality of transverse upper supporting yielding idler spool rollers 356 (FIG. 4) therealong to provide a dished contour to the belt 354. Lower return rollers for the conveyor system are shown at 357. The conveyor assembly or belt 354 is known in the art and need not be futher described.

It is apparent that the cuttings from the cutter 144 will accumulate within the scoop 140 and in front of the moldboard 270 and be moved or thrown through the opening 142 upon the conveyor belt 354 and thus be moved in the direction of the arrow 360 to the rear of the machine.

Figure 10:
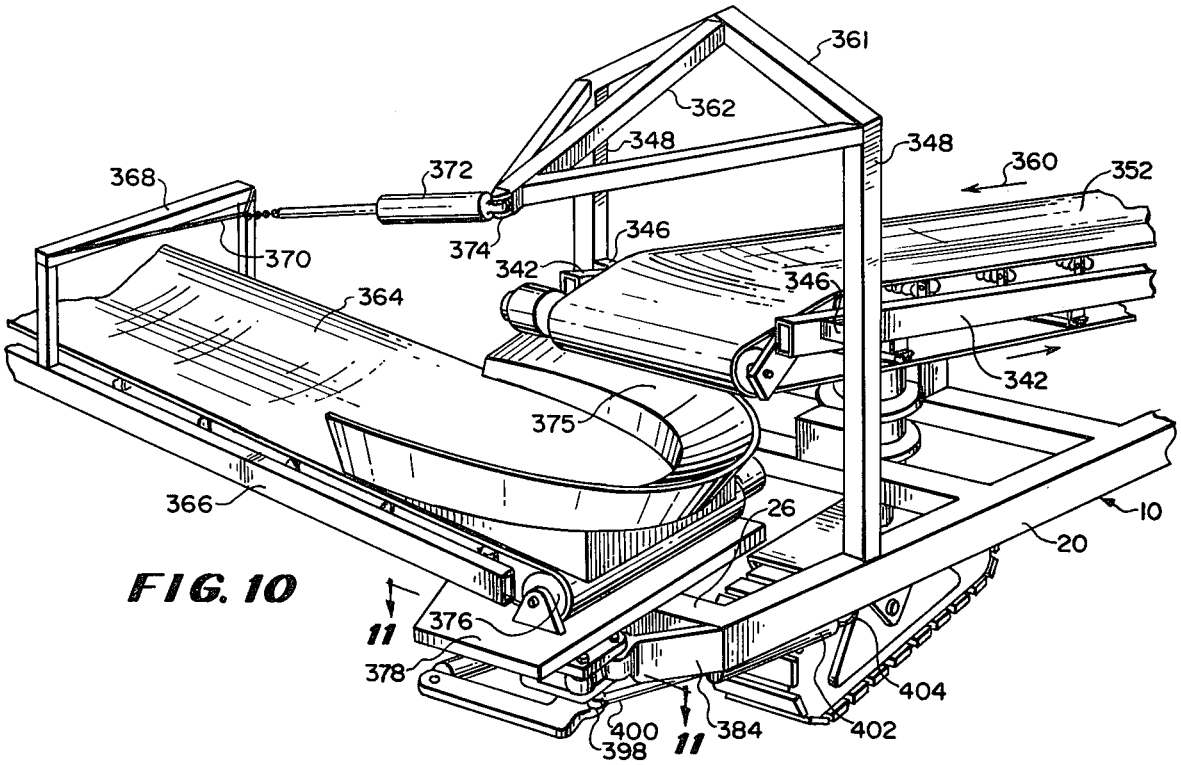
FIG. 10 is a fragmentary perspective view of the rear end of the machine to show the articulation of the conveyor.

The discharge end of the conveyor 352 is shown in FIG. 10. Here the upright frame structure 348 is provided with the beams 361 and the rearwardly extending braces 362 which are used to support the second conveyor belt 364 having the frame 366 through the U-bracket 368, suitably tied by cables 370 to the ram 372, back to the pivot point 374 of the braces. An arcuate apron 375 is provided at the receving end of the conveyor 364. Since these structures are known, they need not be further described.

Figure 12:
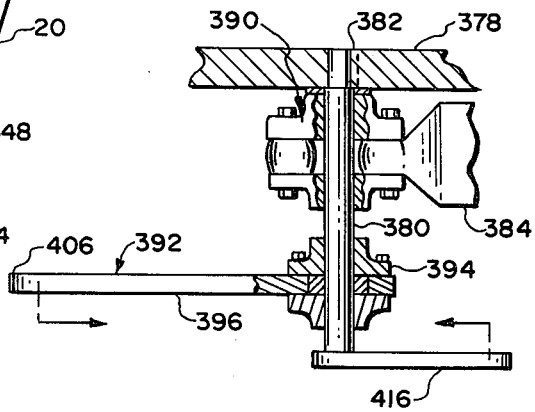
FIG. 12 is a fragmentary cross-sectional view taken along the lines 12—12 of FIG. 11.

One of the end rollers for the conveyor 364 is shown at 376 supported from the turntable 378 upon the spindle 380 (see FIG. 12). The turntable 378 is keyed at 382 or otherwise affixed to the spindle at its top end. The spindle 380 is approximately aligned with the pivot 374 on a vertical axis from the rear of the frame by means of the diagonal braces 384 and 386 supporting the heavy duty bearing 390.

The L-shaped rotatable lever 392 attaches to the spindle 380 by means of the bearing 394. The shorter leg 396 of the L-shaped lever 392 provides the pivot 398 to which the piston rod 400 of the dual acting ram 402 is attached. The other end of the ram 402 is pivoted to the frame member 20 by means of the front pivot 404. ram 408 at the end pivot 410. This ram 408 has its piston rod 412 connected at the end pivot 414 to the second lever 416 which has its other end attached or splined to the lower end of the spindle 380. Turning of the lever 416 turns the spindle 380 and the turntable 378.

Figure 11:
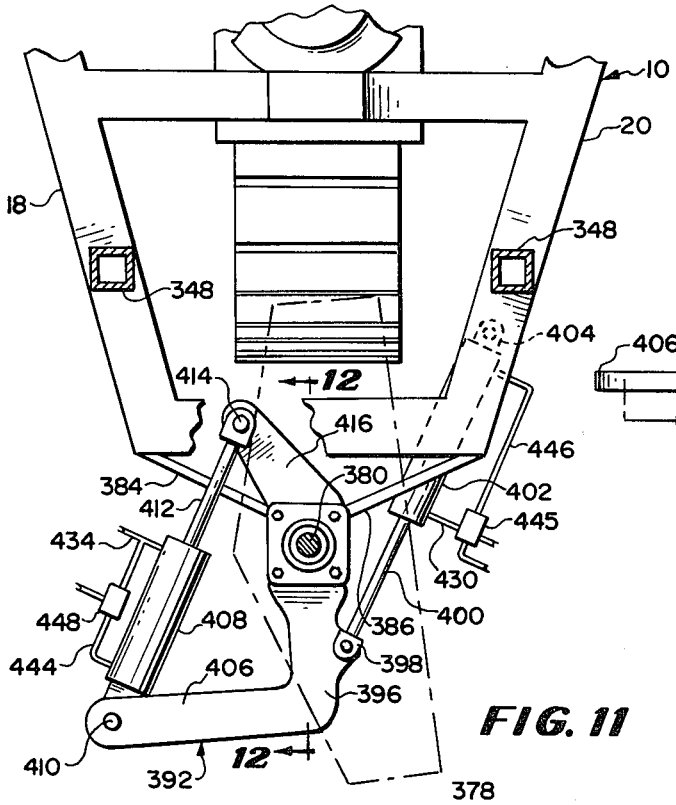
FIG. 11 is a fragmentary cross-sectional view taken along the lines of 11—11 of FIG. 10.

In FIGS. 10 and 11, the conveyor 364 and the supportive turntable 378 are shown turned about 90° from the longitudinal axis of the main frame to deposit the cuttings along that side of the machine or in a truck traveling with the machine. In this position both of the rams 402 and 408 are in their extended positions. To rotate the conveyor so that it conveys the cuttings directly to the rear of the machine, the ram 408 may be retracted (as an illustrative sequence) while the ram 402 remains extended. Since the lever 416 is attached to the spindle 380 and the lever 392 is fixed by the ram 402, this contraction will rotate the spindle and the conveyor will swing in a counter-clockwise direction to the next desired position within the limits of the ram 408.

Assuming that the geometry of the assembly is such that full contraction of the ram 408 brings the conveyor to a 90° position from that shown in FIGS. 10 and 11, it will then extend directly to the rear. If the ram 408 only moves the conveyor a portion of the 90° swing, the ram 402 is contracted while ram 408 is locked. This will swing the conveyor the balance of the 90° . From this position, since ram 408 is fully retracted and locked, the ram 402 on being further retracted will swing the conveyor from this midpoint to the other side so that it extends from the frame in a postion 180° from that shown in FIGS. 10 and 11.

Reversal of these functions of the rams 402 and 408 will swing the conveyor 364 back to its in-line position or to the positions shown in FIGS. 10 and 11. Alternately, it is apparent that the rams 402 and 408 can be operated in different sequences to accomplish these results. Thus, with the ram 408 locked, the ram 402 can be the first to retract to accomplish the first segment of turning from the 90° position of FIGS. 10 and 11 or to any desired position within the limits of the contraction of ram 402. Then to complete the rotation in a counter-clockwise direction the ram 408 can be retracted or stopped at any desired intermediate position. Again reversal of these functions will accomplish the return of the conveyor from the position 180° from that shown in FIGS. 10 and 11, back to any intermediate position or to that of FIGS. 10 and 11. It is also apparent that the rams 402 and 408 can share in these functions by simultaneous contraction or extension wherein each moves the spindle or the purchase point defined by the pivot 410 a proportionate amount of the turning segment. The functions of the pilot valves 445 and 448 are described in relation to FIG. 13.

Figure 13:
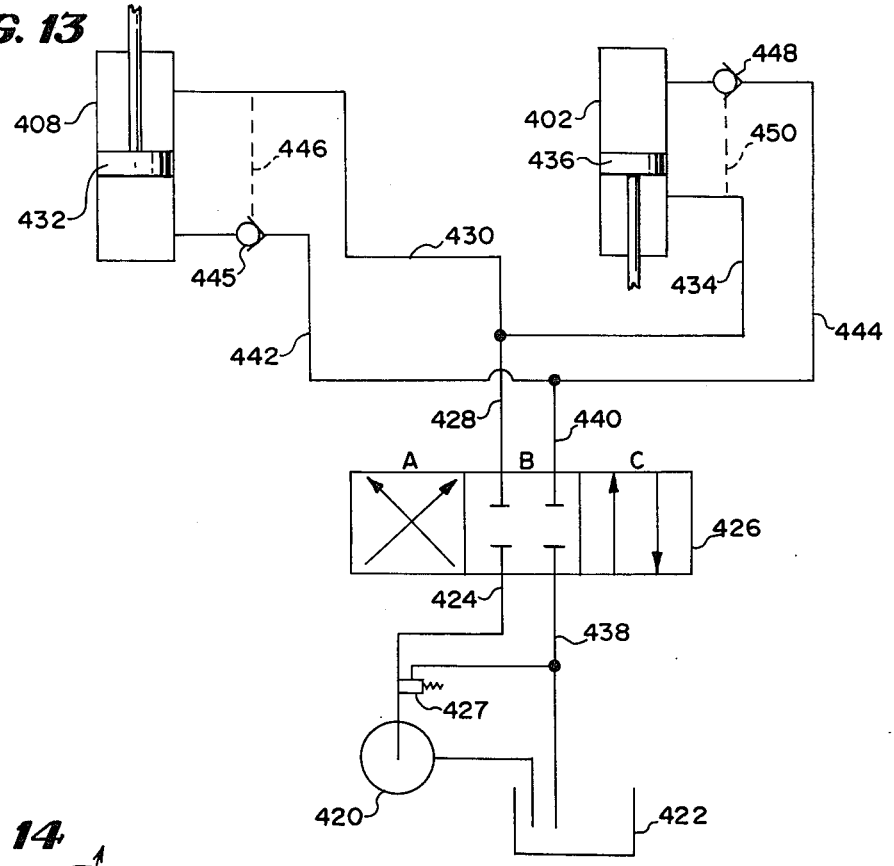
FIG. 13 is a schematic of the servo-hydraulic control for the positioning rams of the tail boom conveyor.

For these purposes the hydraulic system shown in FIG. 13 can be used for the rams 402 and 408, these parts being shown diagrammatically. The pump 420 supplies oil from the sump 422 via the pressure line 424 to the three-position solenoid valve 426, shown in the closed or locked position. A pressure relief valve 427 is provided in the system. The pressure line 428 leads from the solenoid valve 426 to the first branch line 430 connected to one side of the piston 432 of the ram 408 and to the second branch line 434 leading to one side of the piston 436 of the ram 402. The pressure return or low pressure line 438 communicates with the sump 422 on one side of the valve 426 and communicates with the line 440 and branch lines 442 and 444, the former leading to the other side of the piston 432 and the latter leading to the other side of piston 426.

The line 442 has the pilot or one-way valve 445 therein and is also connected therethrough by the branch line 446 to the line 430. The line 44 has the pilot or one-way valve 448 therein and is connected therethrough by the branch line 450 to the line 434. This completes the circuit for purposes of explaining the functioning of these parts in one aspect of this invention. The purpose of the pilot valves 445 and 448 is to maintain the pistons 432 and 436 in certain locked postions so that the momentum of the heavy conveyor 364 will not continue to exert torque on the spindle 380 and allow the assembly to swing by a desired position or cause accidents.

The value 426 can be operated from a manual switch located at the console 40. The value 426 has the positions A, B and C indicated diagrammatically in FIG. 13. In the position B lines 424 and 438 and their counterparts 428 and 440 are closed. There is not input pressure or outlet to the rams 402 and 408, and they are locked. Moving the connections to position C allows hydraulic fluid to pass from the input line 424 into the lines 428, 430 and 434. The rams 402 and 408 will both contract, and the conveyor 364 will begin to swing. Part of the pressure in the line 430 passes through the line 446 and opens the pilot valve 445 to allow oil ahead of the piston 432 to escape. Likewise, part of the pressure in line 434 passes through the line 450 and opens the pilot valve 448 to allow oil ahead of the piston 402 to escape via lines 444, 440 and 438 to sump 422. The moment the valve 426 is moved to the B position, both pilot valves 445 and 448 close completely and the system locks to hold the conveyor in place against any momentum.

Shifting of the valve 426 to A position causes the functions of the lines 428 and 440 to reverse and oil under pressure passes through the line 442, opening the pilot valve 444 and extending the ram 408, and oil under pressure passes through the line 444, opening the pilot valve 448 to cause the ram 402 to extend. The return lines 430, 434 and 428 are open to the sump 422. The moment the valve 426 is moved to the B position, the check valves 444 and 448 are allowed to close. Any pressure in the lines 446 and 450 is maintained and the rams are locked. The momentum of the conveyor is overcome. A pressure-compensated pump such as a John Deer PV 60 can be used in the system shown in FIG. 13 to replace the valve 426 and pump 420.

As previously described the purpose of this invention is to isolate slope changes from grade changes. Is is apparent that the two extensible members 42 (on the left side) and 43 (on the right side) of the machine are used to control the slope and grade of the cutting tool 144 as the machine progresses along the grade line 332. The slope is under the control of the pendulum controlled valve 340, carried by the moldboard 270 and the grade is under the control of the grade control instrument 328, also carried by the moldboard 270. By placing these controls on the moldboard 270, the moldboard is maintained in the same relationship to the controlling reference whether it is the string line 332 or the slope control 340. Also by placing the slope control 340 on one side of the moldboard it is no longer inertia sensitive and has only a rotary input. If the pendulum is placed on the opposite end of the moldboard 270, it is inertia sensitive since it will physically swing in an arc during corrections and introduce errors or excess hunting in the servo-hydraulic system.

Slope is a function of grade but grade is not function of slope. Assuming a given slope is established across the machine by the extensible members 42 and 43. When a grade change is called for by the sensor 328, in order to maintain the slope, the members 42 and 43 must extend or retract simultaneously and by the same amount. If the member 43 is used for slope control and the grade reference is taken opposite the member 42, then anytime the member 42 adjusts the member 43 must also adjust. By cross connecting the input lines to the members 42 and 43 on both of their pressure and return lines with a pilot operated lock valve, the slope can be isolated from grade. Thus, if the grade control calls for the member 43 to raise or lower the valves lock open so that the members 42 and 43 can move in usison. If the slope control calls for a correction of the members 43, the pilot operated valves are closed and a slope correction is made without influencing the member 42.

The degree of steering and/or drive speed of the rear tractor 100 can be co-ordinated with the driving speed differential of the fixed front tractors 54 and 55 in a number of ways. In order to test the feasibility of the concept, the drive motors 60 on the tractors 54 and 55 were placed under various means of control. It was found that the amount of control (speed differential) required depends on the size, weight and geometry of the machine. For large machines or small machines, a speed differential has to be imposed into the drive tractors 54 and 55 in order to obtain controlled and accurate steering. However, there is an area in between wherein the machine size permits the tractors to seek their own differential.

Initially mechanically-operated speed control valves connected with the individual high pressure input lines leading to the front drive motors 60 for the tractors 54 and 55 and an actuating arm which extended radially from the rear support means 80 to open and close the control valves by an amount proportional to the degree of steering were tried and proved to be moderately successful. For this purpose, separate hydraulic pumps are used, one for the motors of the tractors and one for the steering control ram 116.

Figure 14:
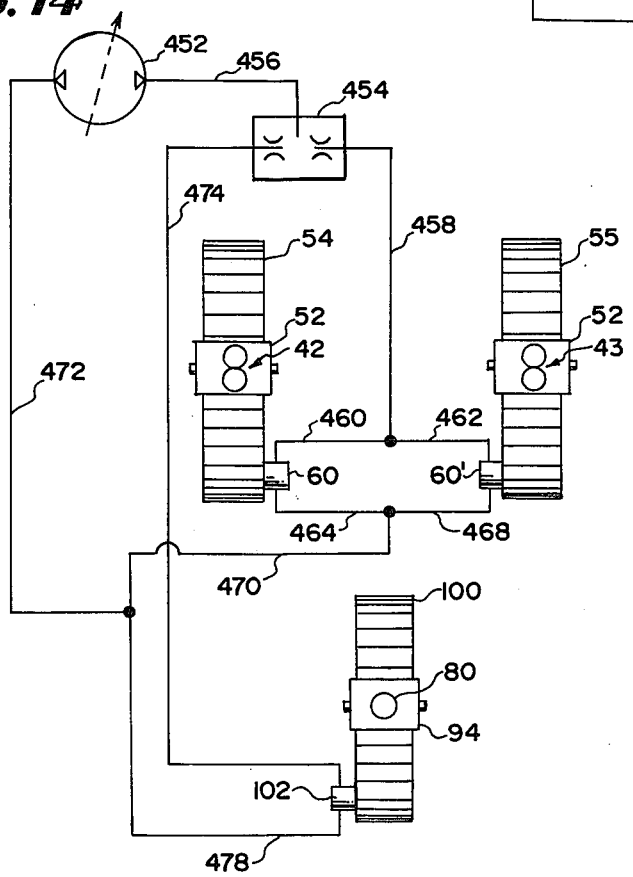
FIG. 14 is a diagram of one form of the hydraulic steering drive control.

This hydraulic system was modified by replacing the speed control valves and ordinary pump with a variable pressure compensated pump 452 as shown in FIG. 14. This diagram shows only the essential parts of the machine including the front tracks 54 and 55, their respective drive motors 60 and 60', the saddle 52 and the vertically adjustable mounts 42 and 43 therefore. The rear tractor 100 in this instance is smaller than the two front tractors.

The output from the pump 452 is connected to the divider-combiner 454 by the line 456. 66% of the pump output flows via line 458 to the branch lines 460 and 462, connected to the input sides of the drive motors 60 and 60' for the front pair of tractors. The expended oil is conveyed by the branch lines 464 and 468 to the return lines 470 and 472 leading back to the pump.

The line 474 conveys 33% of the output to drive motor 102 for the rear tractor 100 and the return from this drive motor is conveyed by the line 478 back to the return line 472 and to the pump 452. Thus each motor (60, 60' and 102) is receiving about 33% of the pump output as the machine travels a straight line.

As the rear tractor 100 is turned in response to a steering correction sensed by the sensing arm 330, by the steering ram 116 (not shown), that front tractor which is on the outside of the curve will automatically be driven faster than the inside tractor since the output in line 458 can divide into the branch lines 460 or 462. The rear tractor 100 will be driven by its motor 102 at substantially the same speed since the effect of one tractor's speed on the other is less. This system is satisfactoy for short-coupled machines.

Figure 15:
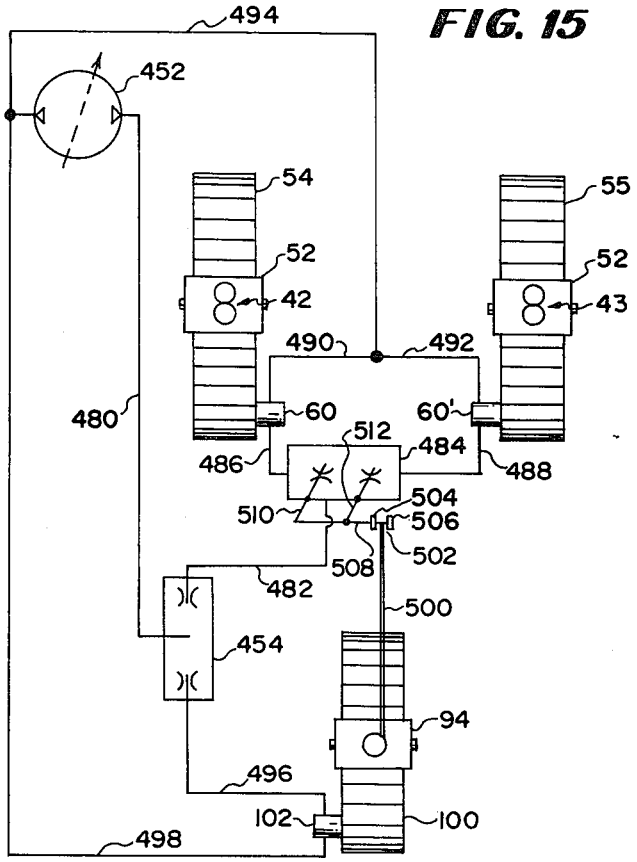
FIG. 15 is a diagram showing another form of hydraulic steering control.

For larger and heavier machines, the hydraulic system of FIG. 15 is preferred and for that matter this system can be used on all sizes of machines using the suspension arangement of this invention.

In FIG. 15 the essential parts of the machine that are shown are the same as in FIG. 14 and similarly numbered. In this instance the speed control valves have been replaced by a fixed ratio divider-combiner, a variable pressure compensated pump and a one-two stage valve or variable divider using a linkage connection to control the input to the drive motors 60 and 60'.

FIG. 15 shows the variable pressure compensated pump 452 with the output line 480, connected to the fixed divider 454. 66% of the pump output flows from the fixed divider 454 through the input line 482 to the variable divider 484 which replaces the speed control valves originaly used. The input line 486 leads from the variable divider 484 to the drive motor 60 for the track 54. The input line 488 leads from the variable divider 484 to the drive motor 60' for the track 55. The return branch lines 490 and 492 lead from these pumps to the return line 494 back to the pump 452. The line 496 delivers 33% of the pump output to the drive motor 102 of the rear steering tractor 100. The line 498 connects from this motor back to the pump 452.

The rear saddle 94 carries the actuating rod 500 and has its end 502 positioned in the space between the stop members 502 and 506 of the reciprocatable rod 508 for the variable divider 484. The reciprocatable rod 508 is connected by means of the actuating rods 510 and 512 to the variable valves within the divider 484.

In this embodiment as the rear tractor 100 is turned in response to a steering correction the end 502 of the actuating rod 500 is swung so as to engage one or the other of the stop members 504 and 506. When a right hand turn (as viewed in FIG. 15) is sensed the variable divider 484 is so actuated as to speed up the motor 60 and slow down the motor 60' by substantially equal amounts. During the negotiation of a turn, the rear drive motor 102 remains at its original speed which is the mathematical average of the speeds of the front two drive motors 60 and 60'. For these purposes, the variable divider 484 may be the type 2V21L8-6-640S, manufactured by Fluid Controls, Inc.

Figure 16:
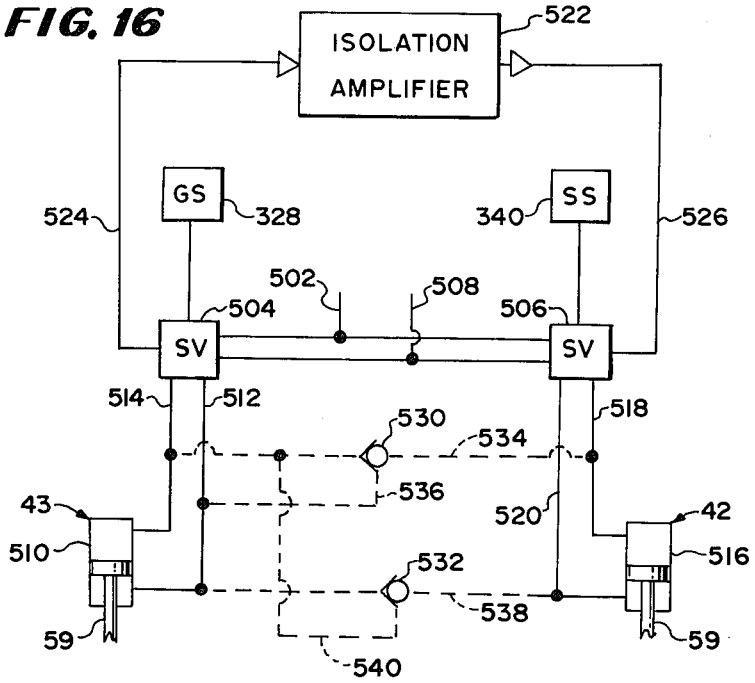
FIG. 16 is a diagram showing two methods of isolating slope control from grade control.

In accordance with one aspect of this invention, the slope and grade corrections, controlled by the pair of adjustable support means 42 and 43, heretofore described, which carry the main weight of the frame 10 and the working tool 140 and the cutter 144, are isolated from one another by the use of the isolation amplifier system or a dual pilot valve system both of which are shown diagrammatically in FIG. 16. The pilot valve system is shown with the connecting conduits in broken lines. The source of hydraulic power is illustrated by the input line 502 leading through branch lines to the servo valve 504 and the servo valve 506. The return line for the hydraulic system is illustrated at 508.

The servo valve 504 controls the ram 510 which illustrates the adjustable support means 43 (heretofore described in FIGS. 2 and 3) by means of the hydraulic lines 512 and 514 connected thereto. The servo valve 506 controls the ram 516 illustrating the adjustable support means 42 by means of the hydraulic lines 518 and 520. The grade sensor 328 controls the valve 504 and the slope sensor 340 controls the valve 506. The isolation amplifier 522 which may be a Honeywell type 24000-2-01 is connnected to and controls both the valves 504 and 506 by the control lines 524 and 526. The arrowheads indicate the direction of intelligence flow.

Thus, when the grade sensor 328 calls for a correction in the height of the tool 144, the valves 504 and 506 are actuated to operate the rams 510 and 516 simultaneously up or down by the amount of the correction without affecting the slope. Through the isolation amplifier, any signal from the grade sensor 328 is automatically sent to the valve 506. However, if the slope sensor 340 sends out a signal calling for a slopt correction, since it is physically located over the ram 516, on the grade line side of the machine, if that ram 516 is on grade the signal is transmitted through the isolation amplifier to the valve 504 and it only adjusts up or down to correct the slope. This adjustment may affect the grade sensor arm slightly in whih event any lowering of the sensor 334 in relation to the grade line 332 will be corrected by the grade sensor 328 acting through the isolation amplifier 522 on the ram 516. Any changes in grade do not affect the slope since the isolation amplifier allows the valves 504 anf 506 to operate simultaneously up or down and the pendulum in the slope control unit 340 is not tilted. If the tractor 54 under the control of the ram 516 strikes and passes over a sudden rise on that side of the machine and the opposite side of the machine controlled by the ram 510 is on grade, then the isolation amplifier prevents the operation of the ram 510 and only the ram 516 is lowered to affect what amounts to a combined correction in grade and slope and instantly lowers by the amount of the rise. Conversely, if the tractor 55, under the control of the ram 510 is on grade, then the isolation amplifier 522 allows the actuation of the servo valve 504 only and the ram 510 (adjustable support 43) lowers by the amount of the rise due to the signal from the slope sensor 340.

Accordingly, in the isolation amplifier system of FIG. 16, if the grade sensor calls for a correction in height, both the members 42 and 43 are operated simultaneously without affecting the slope and if the slope sensor calls for a change, only that member which the slope control intended to activate will be changed. With the grade sensor on the mold-board if the mold-board moves in relation to the frame, it will be maintained in its correct relationship to the external reference or grade line. Likewise, with the slope control on the mold-board it will be maintained in its correct relationship to slope. For a grade change, called for by the grade reference, the members 42 and 45 are moved simultaneously but the rams 284 controlling the mold-board are not changed unless the operator sees the need for a change in the depth of the fluff 292 which is the distance between the cut grade 166 and the bottom edge of the mold-board 272. The fluff varies in depth, depending on whether hard or soft ground is being cut.

FIG. 16 includes an additional embodiment to affect this same type of control without the use of the isolation amplifier 522 and its control lines 524 and 526. This additional embodiment includes the pilot-operated lock valves 530 and 532, with the hydraulic conduit 534 connected across the lines 514 and 518 to the top side of the rams 510 and 516, and the conduit 536 connected from the valve to the line 512 as shown for the former. The line 538 connects across the lines 512 and 520, leading to the bottoms of the rams 510 and 516, and the conduit 540 connects from the valve 532 to the conduit 534. The valves 530 and 532 can be of the type 4K21-N-2-S manufactured by Fluid Controls, Inc.

Assuming that the side of the machine controlled by the ram 516 (adjustable support means 42) is still the slope control side and the grade reference side is connected to the ram 510 as shown in FIG. 16, any time the elevation of the ram 516 is changed, it is desired that the ram 510 is also changed. However, the pilot-operated valve 530, having the pressure-take-off line 536 from the side leading to the servo valve 504 locks open each time the ram 510 is operated downwardly, and the pilot-operated valve 532, having the pressure take-off line 540 locks open each timme the ram 510 is operated upwardly. This means that when the grade sensor 328 calls for a change, the valves 530 or 532 lock open and lines 534–536 communicate or lines 538 and 540 communicate thereby causing the rams 510 and 516 to operate up or down in unison. However, if the slope sensor calls for a change in slope and activation of the ram 516, it is isolated from the ram 510 and extends or retracts independently.

As previously described, steering is manual or controlled automatically by the sensor 326. Manual control of the steering, through the console 40 by means of the lever 66 and 68 is used during abnormal conditions or when driving the machine to and from a tractor trailer or into position adjacent the external grade reference. Once oriented and with the cutting tool, mold-board and conveyor system in proper operation, the machine is placed under the control of the steering sensor 326, especially where the grade being prepared is essentially straight or a large radius cul-de-sac is being negotiated. For shorter turns, manual operation of the steering may be advisable.

The various components and means used to control the hydraulic and electrical system to accomplish these results are known in the art and a number of different sensors, servo valves, pilot operated lock valves and isolation amplifiers are available for these functions.

In summary the machine of this invention incorporates a number of features in that the slope and grade of the working tool and the frame to which it is affixed are under the control of a pair of adjustable frame supports operating on front ground engagement means located on opposite sides of the frame and immediately behind the working tool. The third point of suspension is to the rear of the machine and once the general attitude of the tool is established, since this third point of suspension is operating on the prepared grade no adjustment at the rear is necessary as the machine progresses. By locating the slope sensor, for some applications, behind one edge of the cutting tool and in line with one of the frame support means, it is inertia insensitive allowing the use of a hydraulic system and control that operates the rams within the two side support means simultaneously for grade control and individually for slope control while the rear suspension becomes a relatively fixed third point.

Also the use of an isolation amplifier or pilot operated check valves in the hydraulic system controlling this front pair of suspensions as the means for isolating slope adjustments from grade adjustments allows the machine to operate with a minimum of lag and maximum of sensitivity.

The steering can be manual using sight control along the grade reference or automatic using a sensor operating from a grade line. Where a new grade is being cut beside a previously laid concrete lane, its edge can become the grade reference by the use of a gauge wheel running on the performed lane of concrete.

The placement of both sensors (slope and grade) on the mold-board, which itself is adjustable, allows immediate adjustment of the fluff (the fines left in a layer over the cut grade) as the consistency of the ground varies from hard to soft, etc., along the path of travel. This feature eliminates the re-setting of the grade and slope controls each time the fluff needs adjustment, it being only necessary to unlock the mold-board, make the adjustment and lock the mold-board again. Raising the mold-board also raises the grade control and it causes the front frame support means to retract (lower the frame) with the end result that when the machine is back on grade the depth of the fluff is increased.

The use of gravity operated pendulum valve or the like for slope control and a grade line for grade control both on and along one side of the machine represents a preferred arrangement since this also allows automatic control of the steering. The feature of changing the driving speeds of the front tractors in negotiating a curve would be optional in the field since not all grade cutting jobs would require such precise steering. Accordingly, the working tool can be other than a rotating grade cutter and the machine can employ scarifier and blades to work the earth with or without the use of the mold-board.

What is claimed is:

1. A grade cutting machine comprising:

an elongated frame member having front and rear portions;

a grade cutting tool rotatably mounted on an axis transverse the front portion of said frame member and adapted to deposit loosened earth cutting therebehind;

a moldboard carried by said frame member and having its lower edge extending transverse said frame member and spaced behind said cutting tool to grade said loose cuttings;

means adjustably and vertically supporting the opposite ends of said moldboard from said frame member whereby the elevation of the lower edge of said moldboard in relation to said cutting tool is variable and defines the depth of the layer of loose cuttings deposited upon said grade;

conveyor means having its receiving end in open communication with the loose cuttings graded by said moldboard to remove said cuttings to the rear of the machine;

a pair of ground engagement means disposed adjacent opposite sides of the front portion of said frame member to accommodate transportation of said machine along a path of travel;

front frame support means connecting opposite sides of said front portion of said frame member to the respective ground engagement means and adapted to adjustably support said frame member thereon;

single ground engagement means disposed from the rear central portion of said frame member;

frame support means connected to said rear ground engagement means to adjustably support the rear portion of said frame member;

actuating means supported by said frame member and responsive to an exterior grade reference disposed along said path of travel to be traversed by said machine, said actuating means being operatively connected to said pair of front frame support means whereby to extend and retract same silumtaneously for grade control;

actuating means supported by said frame member and operatively connected to said pair of front frame support means whereby to extend and retract same independently for slope control;

sterring means operatively connected to said single ground engagement means to turn said single ground engagement means on said vertical steering axis;

actuating means operatively connected to said steering means and responsive to the direction of said exterior reference to maintain said machine along said path of travel;

independent drive means for said front pair of ground engagement means and said single ground engagement means; and means connecting said drive means for said pair of front ground engagement means to said steering means for said single ground engagement means whereupon actuation of said steering means induces a change in the driving speed between said front ground engagement means such that the front ground engagement means on the outside of a curve is driven faster than the front ground engagement means on the inside of a curve by a differential inversely proportional to the radius of said curve.

2. A grade cutting machine in accordance with claim 1 wherein:

said actuating means for operating said pair of front frame support means simultaneously for grade control comprises an elevation sensor supported at one end of said moldboard; and said actuating means for operating said pair of front frame support means independently for slope control comprises a slope sensor carried at said one end of said moldboard supporting said elevation sensor and in the fore and aft plane of the vertical adjustable support means for that end of the moldboard.

3. A construction machine comprising:

a frame member;

a transverse rotatable cutting tool carried by said frame member;

a moldboard extending across said frame member behind said tool;

a pair of front ground engagement means disposed adjacent opposite sides of said frame;

front frame support means connecting opposite sides of said frame to respective front ground engagement means and adapted to adjustably support said frame member thereon;

each of said frame support means including an extensible member;

a rear ground engagement means disposed rearwardly and substantially central of said front pair of ground engagement means;

a frame support means connected to said rear ground engagement means and including an extensible member adjustably supporting the rear of said frame member thereon;

actuating means operatively connected to said extensible members of said pair of front frame support means and responsive to an exterior grade control reference disposed along a path of travel of said machine to maintain said frame member and cutting tool at a predetermined height;

means at each end of said moldboard to raise and lower said moldboard a predetermined amount above said grade including a yoke member affixed at each end of said moldboard;

a vertical support member is associated behind the ends of the moldboard;

said yoke members defining openings engaging said vertical support members in sliding guided relationship;

a pair of extensible members are attached between said main frame and said yoke members, said extensible members being adapted for simultaneous vertical movement to raise and lower said yoke members and said moldboard;

said yoke members having one wall spaced from a side of said vertical support members;

a lock member pivotally mounted in said one wall of each of said yoke members and presenting a cam surface toward said side of said vertical support members;

means to simultaneously rotate said lock members whereby said cam surfaces are brought to bear on said sides of said vertical support members to affix the vertical position of said moldboard in relation to the cut grade prepared by said working tool and define the depth of fluff prepared by said machine;

actuating means for said rear frame support means and said extensible member to control the fore and aft attitude of said cutting tool;

means to steer said rear ground engagement means on a vertical steering axis; and actuating means operatively connected to said steering means and responsive to the direction of said grade control reference to maintain said machine along a path of travel parallel to said exterior grade control reference.

4. A construction machine in accordance with claim 3 including:

a grade sensor carried at one end of said moldboard and operatively connected to said actuating means for said pair of front frame support means;

a slope sensor carried at the same end of said moldboard and operatively connected to said pair of front frame support means;

said grade and slope sensors being thereby isolated from one another whereby a grade correction is accomplished by simultaneous actuation of said extensible members associated with said front frame support means and a slope correction is accomplished by the individual actuation of said extensible members.

5. A construction machine in accordance with claim 3 in which:

said cutting tool comprises an elongated rotary cutter having a plurality of radial cutting teeth spaced along a tubular shaft;

said cutting teeth being arranged in a plurality of groups along said shaft;

the cutting teeth in each group being equally spaced circumferentially about said shaft; and the cutting teeth in each adjacent group being circumferentially offset around said shaft whereby any given cutting tooth of a group is substantially equidistant from the cutting teeth on either side.

6. A construction machine comprising:

a frame member;

a working tool carried by said frame member;

a pair of front ground engagement means disposed adjacent opposite sides of said frame member;

a hydraulic drive motor for each of said front ground engagement means;

front frame support means connecting opposite sides of said frame to respective ground engagement means and adapted adjustably support said frame member thereon;

each of said frame support means including a ram member;

rear ground engagement means disposed on a vertical steering axis rearwardly and substantially central of said front pair of ground engagement means;

a hydraulic drive motor for said rear ground engagement means;

actuating means for said ram members of said front frame support means including a source of hydraulic pressure and return system connected thereto;

a pair of servo-valve means within said system;

a grade sensor operatively associated with an external grade reference and controlling the servo-valve means for one of said rams on one side of said main frame;

a slope sensor connected to and controlling the servo-valve means for the other of said rams and being located in said one said of said main frame;

an isolation amplifier connected to said servo-valves whereby signals from said grade sensor are sent to said servo-valve means for one of said rams for grade adjustment and signals from said slope sensor are sent exclusively to the other of said rams for slope adjustment;

steering sensor means carried by said main frame and operatively associated with an exterior steering reference;

means to steer said rear ground engagement means including a steering ram operatively connected thereto to rotate said rear ground engagement means on its vertical steering axis;

said steering ram being connected to said hydraulic system through a variable pressure compensated pump having an outlet;

a fixed divider connected to said outlet conveying two thirds of the hydraulic flow to a variable divider means and one-third of the hydraulic flow to the hydraulic drive motor for said rear ground engagement means;

said variable divider means including a pair of lever-actuated variable valves, one of said variable valves having its output connected to one of said front hydraulic drive motors and the other variable valve having its output connected to the other of said front hydraulic drive motors;

and arm means connected between said rear ground engagement means to actuate said levers of said variable valves whereby a signal from said steering sensor means actuates said steering ram and said arm means to open the variable valve of said variable divider means to speed up the hydraulic drive motor for said front ground engagement means on the outside of a curve and slow down the hydraulic drive motor for said front ground engagement means on the inside of a curve.

7. A construction machine in accordance with claim 6 including:

a mold board extending across said frame behind said working tool and;

means adjustably and vertically supporting the opposite ends of said mold board from said frame member whereby the elevation of the lower edge of said mold board in relation to said cutting tool is variable and defines the depth of the layer of loose cuttings deposited upon said grade along the path of travel of said machine.

8. A grade cutting machine comprising:

an elongated frame member having front and rear portions;

a grade cutting tool rotatably mounted on an axis transverse the front portion of said frame member and adapted to deposit loosened earth cuttings therebehind;

a moldboard carried by said frame member and having its lower edge extending transverse said frame member and spaced behind said cutting tool to grade said loose cuttings;

means adjustably and vertically supporting the opposite ends of said moldboard from said frame member whereby the elevation of the lower edge of said moldboard in relation to said cutting tool is variable and defines the depth of the layer of loose cuttings deposited upon said grade;

conveyor means having its receiving end in open communications with the loose cuttings graded by said moldboard to remove a substantial portion of said cuttings to the rear of said machine;

a pair of ground means disposed adjacent opposite sides of the front portion of said frame member behind said moldboard to accommodate transportation of said machine along a path of travel;

front frame support means including hydraulic ram members connecting opposite sides of said front portion of said frame member to the respective ground engagement means and adapted to adjustably support said frame member thereon;

a single ground engagement means disposed from the rear central portion of said frame member;

single frame support means including hydraulic ram members connected to said rear ground engagement means to adjustably support the rear portion of said frame member and providing a vertical steering axis therefor;

steering means operatively connected to said single frame support means to turn said rear ground engagement means on said vertical steering axis;

actuating means for said ram members of said front frame support means including a source of hydraulic pressure and return system connected thereto;

a pair of servo-valve means within said system;

a grade sensor operatively associated with an external grade reference and controlling the servo-valve means for one of said rams on one side of said frame member;

a slope sensor connected to and controlling the servo-valve means for the other of said rams and being located in said one side of said frame member;

an isolation amplifier connected to said servo-valves whereby signals from said grade sensor are sent to said servo-valve means for one of said rams for grade adjustment and signals from said slope sensor are sent exclusively to the other of said rams for slope adjustment;

actuating means operatively connected to said steering means and responsive to the directon of said exterior grade reference to steer said machine;

independent drive means for said front pair of ground engagement means and said rear ground engagement means; and means connecting said drive means for said pair of front ground engagement means to said steering means for said rear ground engagement means whereupon actuation of said rear steering means induces a change in the driving speed between said front ground engagement means such that the front ground engagement means on the outside of a curve is driven faster than the front ground engagement means on the inside of the curve by a differential inversely proportional to the radius of the curve.

9. A grade cutting machine comprising:

an elongated frame member having front and rear portions;

a grade cutting tool rotatably mounted on an axis transverse the front portion of said frame member and adapted to deposit loosened earth cuttings therebehind;

a moldboard carried by said frame member and having its lower edge extending transverse said frame member and spaced behind said cutting tool to grade said loose cuttings;

means adjustably and vertically supporting the opposite ends of said moldboard from said frame member whereby the elevation of the lower edge of said moldboard in relation to said cutting tool is variable and defines the depth of the layer of loose cuttings deposited upon said grade;

conveyor means having its receiving end in open communications with the loose cuttings graded by said moldboard to remove a substantial portion of said cuttings to the rear of said machine;

a pair of front track frames each carrying an endless track and disposed adjacent opposite sides of the front portion of said frame member behind said moldboard to accommodate transportation of said machine along a path of travel;

a hydraulically driven motor for each of said front endless tracks;

front frame support means including a pair of hydraulically operated rams connecting opposite sides of said front portion of said frame member to the respective front track frames to provide vertical adjustment;

a single rear track frame carrying an endless track disposed from the rear central portion of said frame member;

a single frame support means including a hydraulic ram connected to said rear track frame to adjustably support the rear portion of said frame member;

a hydraulically driven motor for said rear endless track;

said single frame support means for said rear track frame and endless track being pivotally mounted on a vertical steering axis and including a steering ram connected thereto from said rear portion of said frame to turn said rear track frame and endless track;

a hydraulic pressure and return system connected to said rams and said drive motors;

valve means within said system and valve actuating means for said valves;

the valve actuating means for said pair of rams of said front frame support means being responsive to an exterior control reference disposed along one side of the path of travel to operate said pair of rams simultaneousy for grade control;

the valve actuating means for said pair of rams of said front frame support means being responsive to a slope control means to operate said pair of rams individually for slope control;

isolation means in said hydraulic system whereby the slope control actuating means is isolated from said grade control actuating means;

the valve actuating means for said steering ram being responsive to the direction of said exterior control reference to steer said machine;

separate means to control the valve means for the drive motors controlling the speed of said pair of front endless tracks including a pivotal control lever for each extending in spaced relationship; and means responsive to the degree of said direction change including a third control lever affixed to said vertical steering axis and extending into operable relationship with said pivotal control levers whereby the actuation of said steering ram actuates the pivotal control lever of the speed control for that endless track on the outside of the curve to be negotiated and its speed is increased by an increment inversely proportional to the radius of the curve.

10. A grade cutting machine comprising:

an elongated frame member having front and rear portions;

a grade cutting tool rotatably mounted on an axis transverse the front portion of said frame member and adapted to deposit loosened earth cuttings therebehind;

a moldboard carried by said frame member and having its lower edge extending transverse said frame member and spaced behind said cutting tool to grade said loose cuttings;

means adjustably and vertically supporting the opposite ends of said moldboard from said frame member whereby the elevation of the lower edge of said moldboard in relation to said cutting tool is variable and defines the depth of the layer of loose cuttings deposited upon said grade;

conveyor means having its receiving end in open communications with the loose cuttings graded by said moldboard to remove a substantial portion of said cuttings to the rear of said machine;

a pair of front track frames each carrying an endless track and disposed adjacent opposite sides of the front portion of said frame member behind said moldboard to accommodate transportation of said machine along a path of travel;

a hydraulically driven motor for each of said front endless tracks;

front frame support means including a pair of hydraulically operated rams connecting opposite sides of said front portion of said frame member to the respective front track frames to provide vertical adjustment;

a single rear track frame carrying an endless track disposed from the rear central portion of said frame member;

a single frame support means including a hydraulic ram connected to said rear track frame to adjustably support the rear portion of said frame member;

a hydraulically driven motor for said rear endless track;

said single frame support means for said rear track frame and endless track being pivotally mounted on a vertical steering axis and including a steering ram connected thereto from said rear portion of said frame to turn said rear track frame and endless track;

a hydraulic pressure and return system connected to said rams and said drive motors;

valve means within said system and valve actuating means for said valves;

the valve actuating means for said pair of rams of said front frame support means being responsive to an exterior control reference disposed along one side of the path of travel to operate said pair of rams simultaneously for grade control;

the valve actuating means for said pair of rams of said front frame support means being responsive to a slope control means to operate said pair of rams individually for slope control;

isolation means in said hydraulic system whereby the slope control actuating means is islated from said grade control actuating means;

the valve actuating means for said steering ram being responsive to the direction of said exterior control reference to steer said machine;

a variable pressure compensated pump in said hydraulic system;

a fixed divider connected to the output of said pump;

said fixed divider discharging about two-thirds of said output to said drive motors for said front pair of endless tracks and about one-third of said output to said drive motor for the rear endless track whereby in negotiating a curve under the control of the rear endless track that drive motor for the front track on the outside of the curve will be driven faster than the drive motor for the opposite front endless track.

11. A grade cutting machine comprising:

an elongated frame member having front and rear portions;

a grade cutting tool rotatably mounted on an axis transverse the front portion of said frame member and adapted to deposit loosened earth cuttings therebehind;

a moldboard carried by said frame member and having its lower edge extending transverse said frame member and spaced behind said cutting tool to grade said loose cuttings;

means adjustably and vertically supporting the opposite ends of said moldboard from said frame member whereby the elevation of the lower edge of said moldboard in relation to said cutting tool is variable and defines the depth of the layer of loose cuttings deposited upon said grade;

conveyor means having its receiving end in open communications with the loose cuttings graded by said moldboard to remove a substantial portion of said cuttings to the rear of said machine;

a pair of front track frames each carrying an endless track and disposed adjacent opposite sides of the front portion of said frame member behind said moldboard to accommodate transportation of said machine along a path of travel;

a hydraulically dirven motor for each of said front endless tracks;

front frame support means including a pair of hydraulically operated rams connecting opposite sides of said front portion of said frame member to the respective front track frames to provide vertical adjustment;

a single rear track frame carrying an endless track disposed from the rear central portion of said frame member;

a single frame support means including a hydraulic ram connected to said rear track frame to adjustably support the rear portion of said frame member;

a hydraulically driven motor for said rear endless track;

said single frame support means for said rear track frame and endless track being pivotally mounted on a vertical steering axis and including a steering ram connected thereto from said rear portion of said frame to turn said rear track frame and endless track;

a hydraulic pressure and return system connected to said ram and said drive motors;

valve means within said system and valve actuating means for said valves;

the valve actuating means for said pair of rams of said front frame support means being responsive to an exterior control reference disposed along one side of the path of travel to operate said pair of rams simultaneously for grade control;

the valve actuating means for said pair of rams of said front frame support means being responsive to a slope control means to operate said pair of rams individually for slope control;

isolation means in said hydraulic system whereby the slope control actuating means is isolated from said grade control actuating means;

the valve actuating means for said steering ram being responsive to the direction of said exterior control reference to steer said machine;

a variable pressure compensated pump in said hydraulic system;

a fixed divider connected to the output of said pump;

said fixed divider discharging about two-thirds of said output to a variable divider connected to the respective drive motors for said front endless tracks and discharging about one-third of said output to the drive motor for the rear endless track;

a radially extending control lever affixed to said vertical pivot of said rear endless track;

said control lever being operably connected at its extended end to said variable divider whereby in negotiating a curve that drive motor for the front track on the outside of the curve will receive a greater share of said output and be driven faster than the drive motor of the opposite front track.

12. A construction machine comprising;

a frame member;

a grade cutting tool rotatably mounted on an axis transverse the front portion of said frame member;

an open-bottom scoop is provided surrounding said grade cutting tool, said scoop having enclosing side walls, an arcuate top plate member, and a front opening adjacent said grade cutting tool;

a series of transversely disposed shielding plates is provided across said front opening, said plates being hinged one to the other on transverse longitudinal axes; and means are provided to raise and lower said series of plates whereby the lower most plate is maintained immediately above the rough grade;

a pair of front ground engagement means disposed adjacent opposite sides of said frame;

front frame support means connecting opposite side of said frame to respective front ground engagement means and adapted to adjustably support said frame member thereon;

each of said frame support means including an extensible member;

a rear ground engagement means disposed rearwardly and substantially central of said front pair of ground engagement means;

a frame support means connected to said rear ground engagement means and including an extensible member adjustably supporting the rear of said frame member thereon;

actuating means operatively connected to said extensible members of said pair of front frame support means and responsive to an exterior grade control reference disposed along a path of travel of said machine to maintain said frame member and working tool at a predetermined height;

actuating means for said rear frame support means and said extensible member to control the fore and aft attitude of said working tool;

means to steer said rear ground engagement means on a vertical steering axis; and actuating means operatively connected to said steering means and responsive to the direction of said grade control reference to maintain said machine along a path of travel parallel to said exterior grade control reference.

13. A grade cutting machine in accordance with claim 12 in which:

the topmost plateof said series of shielding plates is affixed to the ends of at least a pair of spaced flexible members that extend over the arcuate top plate of said scoop, said means to raise and lower said series of shielding plates comprises;

an extensible member connected between said frame and an axle rotatably supporting a pulley for each of said flexible members;

said flexible members being trained around said pulleys and having their other ends affixed to said arcuate top plate forward of said axle;

whereby the operation of said extensible member effectively fore-shortens and lengthens said flexible members and thereby raises and lowers said shielding plates.

14. A grade cutting machine in accordance with claim 13 in which:

guide means are provided between the sidewalls of said scoop and one of the shielding plates to maintain straightline motion upon actuation of said extensible member.

* * * * *

CERTIFICATE OF CORRECTION

PATENT NO. : 4,041,623
DATED : August 16, 1977
INVENTOR(S) : David J. Miller; Charles P. Miller It is certified that error appears in the above-identified patent and that said Letters Patent are hereby corrected as shown below:

Column 3, line 2, change "rigidity" to -- rigidify --;

Column 3, line 26, delete "right" and insert -- left --.

Column 5, line 9, change "pairs" to -- pair --;

Column 5, line 52, before "steel" insert -- inch --.

Column 6, line 9, delete "flane" and insert -- flange --.

Column 8, line 23, delete "molboard" and insert -- moldboard -;
line 28, delete "moldborad" and insert - moldboard -;
line 42, after "spaced" insert -- parallel --;
line 45, delete "members" and insert -- member --;
line 51, delete "yielding" and insert -- yieldable -.

Column 9, line 18, before "ram" insert -- The longer leg 406 of the L-shaped lever 392 carries the second --.

Column 10, line 19, delete "426" and insert -- 436 --;
line 22, delete "44" and insert -- 444 --;
line 33, delete "value" and insert -- valve --;
line 37, delete "not" and insert -- no --;
line 55, delete "444" and insert -- 445 --;
line 60, delete "444" and insert -- 445 --;
line 67, delete "Is" (second occurrence) and insert -- It --.

Column 11, line 32, delete "usison" and insert -- unison --;
line 33, delete "members" and insert -- member --;

UNITED STATES PATENT AND TRADEMARK OFFICE

CERTIFICATE OF CORRECTION

PATENT NO. : 4,041,623

DATED : August 16, 1977

INVENTOR(S) : David J. Miller; Charles P. Miller

It is certified that error appears in the above-identified patent and that said Letters Patent are hereby corrected as shown below:

Column 11, line 65, delete "saddle" and insert -- saddles --;

Column 12, line 23, delete "factoy" and insert -- factory --;
line 52, delete "502" and insert -- 504 --.

Column 13, line 33, delete "slopt" and insert -- slope --;
line 39, delete "whih" and insert -- which ---;
line 44, delete "anf" and insert -- and --.

Column 14, line 3, delete "45" and insert -- 43 --;
line 33, delete "timme" and insert -- time --.

Column 15, line 55, delete "cutting" and insert - cuttings -.

Column 16, line 27, delete "sterring" and insert -- steering -.

Column 18, line 44, delete "said" (second occurrence) and insert -- side --.

Column 19, line 46, after "ground" insert -- engagement --.

Column 21, line 17, delete "simultaneousy" and insert --- simultaneously --.

Column 22, line 36, delete "islated" and insert - isolated -.

UNITED STATES PATENT AND TRADEMARK OFFICE

CERTIFICATE OF CORRECTION

PATENT NO. : 4,041,623

DATED : August 16, 1977

INVENTOR(S) : David J. Miller; Charles P. Miller

It is certified that error appears in the above-identified patent and that said Letters Patent are hereby corrected as shown below:

Column 23, line 10, delete "dirven" and insert -- driven --.

Column 24, line 46, delete "plateof" and insert -- plate of -.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*